US009230522B1

(12) United States Patent
Lin

(10) Patent No.: US 9,230,522 B1
(45) Date of Patent: Jan. 5, 2016

(54) HITTING DEVICE FOR CAJON

(71) Applicant: E BIN INDUSTRIAL CO., LTD., Taichung (TW)

(72) Inventor: Hsi Tan Lin, Taichung (TW)

(73) Assignee: E Bin Industrial Co., Ltd., Taichung (TW)

( * ) Notice: Subject to any disclaimer, the term of this patent is extended or adjusted under 35 U.S.C. 154(b) by 0 days.

(21) Appl. No.: 14/644,244

(22) Filed: Mar. 11, 2015

(51) Int. Cl.
*G10D 13/00* (2006.01)

(52) U.S. Cl.
CPC ..... *G10D 13/003* (2013.01)

(58) Field of Classification Search
CPC ..... G10D 13/00; G10D 13/003; G10G 5/00; F16C 35/06; G10K 11/002
USPC ..... 84/422.1, 422.2, 422.3
See application file for complete search history.

(56) References Cited

U.S. PATENT DOCUMENTS

2013/0276617 A1* 10/2013 Gunter ..... G10D 13/02 84/422.1

FOREIGN PATENT DOCUMENTS

| | | |
|---|---|---|
| DE | 202010004042 U1 | 7/2010 |
| DE | 202013006328 U1 | 8/2013 |
| TW | M449259 | 3/2013 |
| TW | M471580 | 2/2014 |
| TW | M471656 | 2/2014 |
| TW | M489360 | 11/2014 |
| TW | M489361 | 11/2014 |

* cited by examiner

*Primary Examiner* — Kimberly Lockett
(74) *Attorney, Agent, or Firm* — Rosenberg, Klein & Lee

(57) ABSTRACT

A hitting device for cajon includes a base having a cajon hitting assembly, a shaft, and a driving portion assembled thereon. When the treading portion is treaded, the first end of the bar member is pivoted about the pivoting portion, so that the bar member drives the driving member to move longitudinally and the arm drives the shaft to rotate along a direction where the cajon hitter moves forward the hitting surface of the cajon.

6 Claims, 8 Drawing Sheets

HITTING DEVICE FOR CAJON

BACKGROUND OF THE INVENTION

1. Field of the Invention

The present invention relates to a percussion instrument, and more particularly to a hitting device for cajon in which the hitting device is driven by treading.

2. Description of the Prior Art

As shown in FIG. 8, a conventional cajon hitting device includes a cajon hitting assembly 91 and a pedal assembly 92. The cajon hitting assembly 91 includes a first post 911. A first shaft 912 is pivoted with the first post 911. A hitter 913 is configured to the first shaft 912. A clamp 914 is configured at the bottom of the first post 911 to clamp a fastening bracket 931 of a cajon 93 for positioning. The pedal assembly 92 includes a base 921 having a pedal plate 922 and a second post 923. The pedal plate 922 is connected to the second post 923 via a driving member 924. A second shaft 925 is connected to the second post 923. The first shaft 912 and the second shaft 925 are connected by a wire 94. Accordingly, when the pedal plate 922 is treaded, the first shaft 912 is rotated, and further drives the second shaft 92 to rotate via the wire 94 so that the hitter 913 is swung radially and percusses to the cajon 93.

In order to allow the cajon 93 be hit, the cajon hitting assembly 91, the pedal assembly 92, and the wire 94 are essential. The pedal assembly 92 is connected to the cajon hitting assembly 91 via the wire 94, such that when the pedal assembly 92 is treaded and the second shaft 925 is rotated, the rotation of the second shaft 925 would further drive the first shaft 912 to rotate via the wire 94 and allows the hitter 913 to hit the cajon 93. However, the pedal assembly 92 makes the cajon hitting device be complicated, and also increases the cost and the time for assembling the cajon hitting device to the cajon 93.

The present invention is, therefore, arisen to obviate or at least mitigate the above mentioned disadvantages.

SUMMARY OF THE INVENTION

One object of the present invention is to address the aforementioned problems and to provide a hitting device for cajon which has lower cost and can be assembled rapidly.

To achieve the above and other objects, a hitting device for cajon is provided and comprises a base, a cajon hitting assembly, a shaft, and a driving portion. The base is formed as elongate shaped and horizontally placed in front of the hitting surface of the cajon. The base has a front portion and a side portion. The front portion is right ahead the hitting surface. The side portion is extending along the width direction of the base. The side portion comprises a pivoting portion thereon. The cajon hitting assembly comprises a post assembled to the front portion of the base. A shaft is assembled on the post. A retractable spring is provided at one side of the post for rotating the shaft resiliently when the shaft is rotated. A cajon hitter is fastened to the shaft so that the cajon hitter swings radially with respect to the shaft when the shaft is rotated. An arm is radially extending from the shaft. The extending direction of the arm directs toward the hitting surface of the cajon. The arm and the pivoting portion are at the same side of the base. The bar member is pivoted at the pivoting portion, and the length direction of the bar member is aligned with the length direction of the base. The bar member has a first end and a second end. The first end of the bar member is extending toward the cajon hitting assembly and underneath the arm. The bar member is provided with a treading portion for treading by a foot. The top end of the linking rod is pivoted to an extending end of the arm, and the bottom of the linking rod is pivoted with the first end of the bar member. When the treading portion is treaded, the first end of the bar member is pivoted about the pivoting portion, so that the bar member drives the driving member to move longitudinally and the arm drives the shaft to rotate along a direction where the cajon hitter moves forward the hitting surface of the cajon.

Wherein, the treading portion is defined between the first end and the second end of the bar member, the driving member is a linking rod, the linking rod and the pivoting portion are configured at opposite sides of the treading portion, the second end of the bar member is distant from the linking rod and pivoted to the pivoting portion, wherein when the treading portion is treaded, the linking rod pivoted to the first end of the bar member is driven to move downward to rotate the shaft along a direction where the cajon hitter is moved forward the hitting surface of the cajon.

Wherein, the pivoting portion is defined between the firs end and the second end of the bar member, the pivoting portion is pivoted with the bar member, the driving member is a linking rod, the linking rod and the treading portion are configured at opposite sides of the pivoting portion, wherein when the treading portion is treaded, the linking rod pivoted to the first end of the bar member is driven to move upward to rotate the shaft along a direction where the cajon hitter is moved forward the hitting surface of the cajon.

Wherein, the pivoting portion is a pair of ears protruded from the base, and an axle passes through the two ears and the second end of the bar member so that the bar member is pivotally connected to the pivoting portion.

Wherein, the treading portion comprises a pedal plate for foot laying and treading.

Wherein, the driving member is a chain.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIG. 1 to FIG. 7, illustrating exemplary embodiments according to the present invention. The embodiments are provided for illustrative purposes, and the claimed scope of the present invention is not limited thereto.

Figure 1:
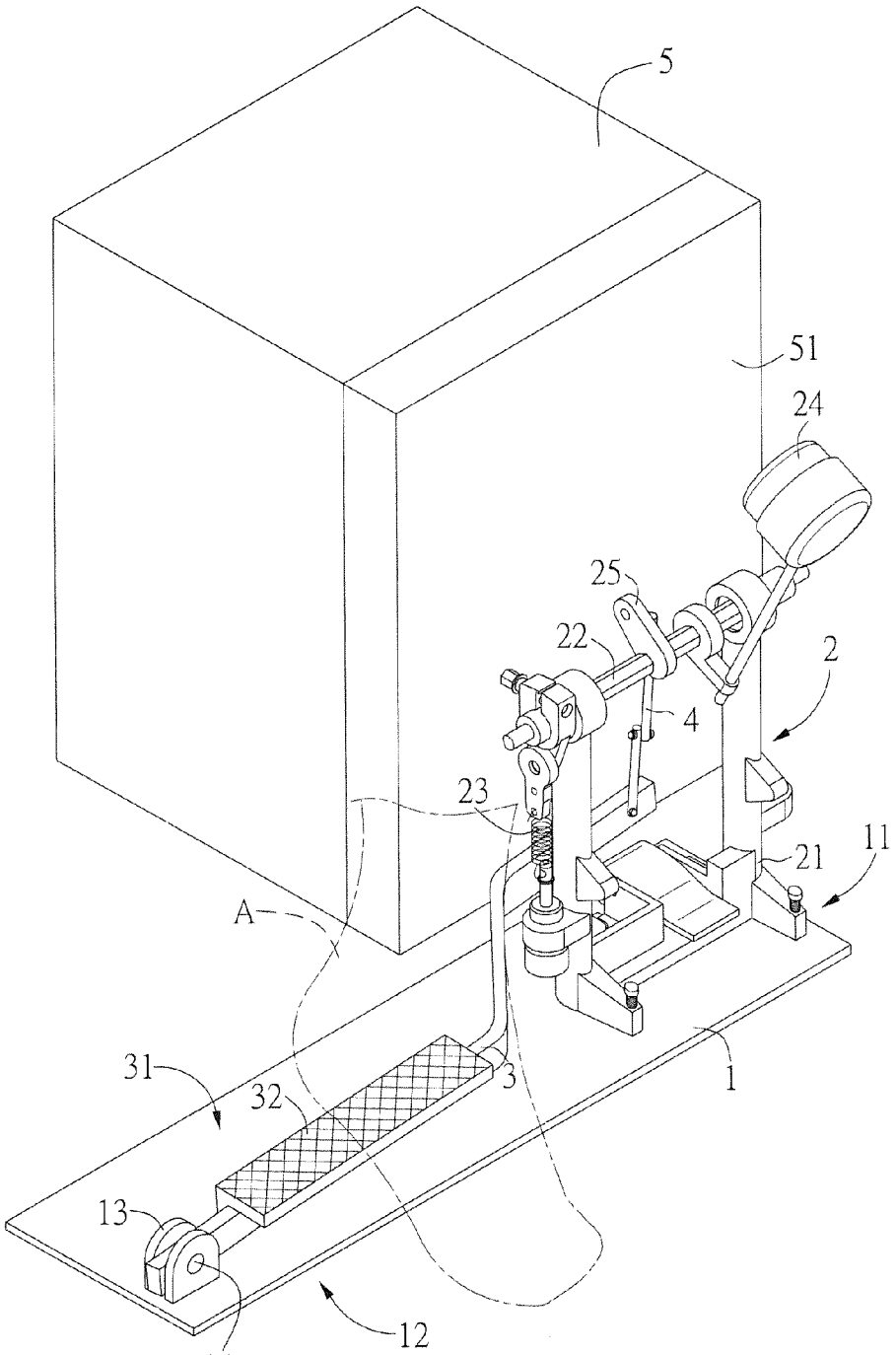
FIG. 1 illustrates a perspective view of a first embodiment of a hitting device for cajon according to the present invention.

A first embodiment according to the present invention provides a hitting device for cajon in which the driving force of the hitting device is transmitted by steel wires, as shown in FIG. 1. The hitting device for cajon comprises a base 1, a cajon hitting assembly 2, a bar member 3, and a driving member. In the first embodiment, the driving member is a linking rod 4 provided for percussing a hitting surface 51 of a cajon 5.

Figure 2:
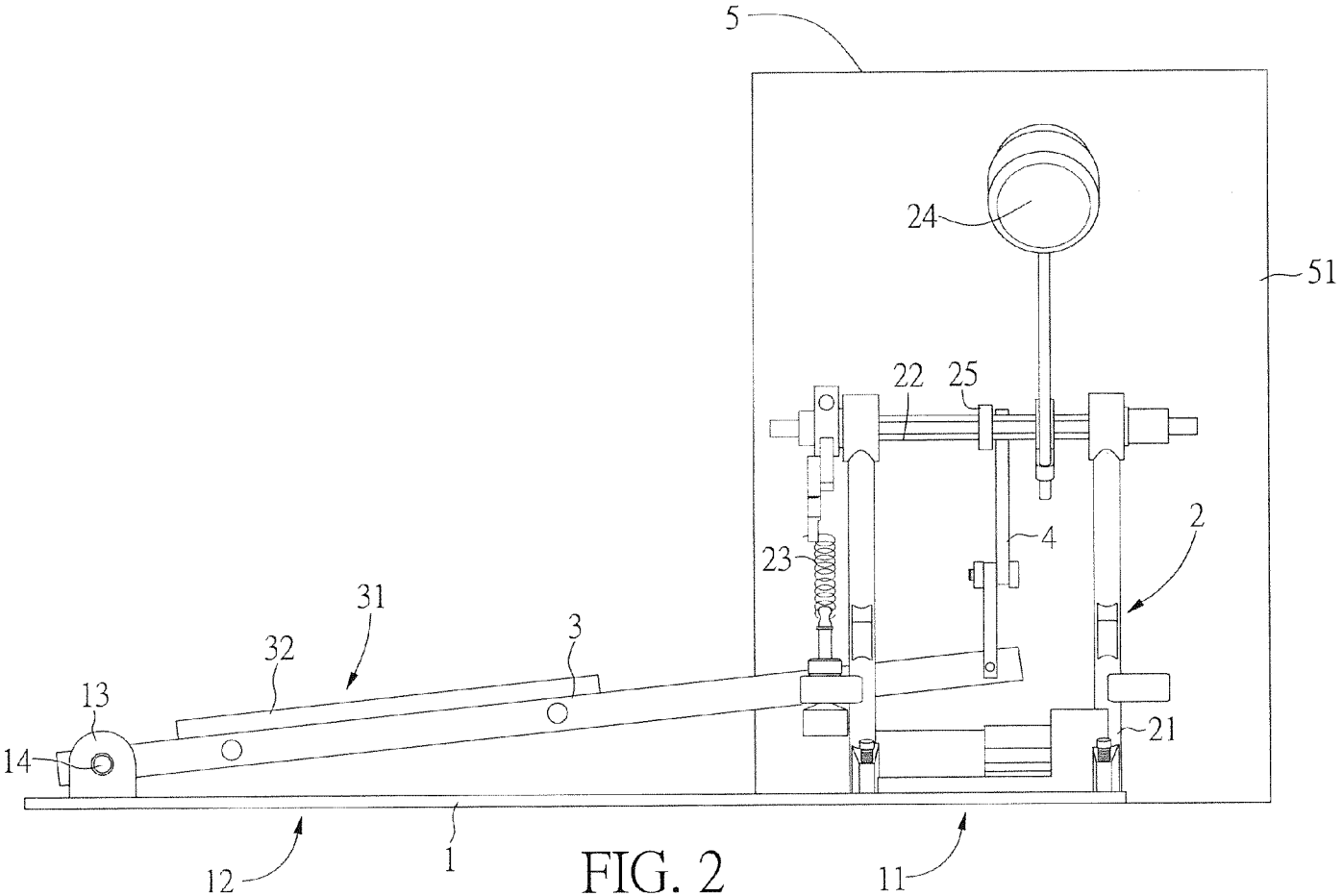
FIG. 2 illustrates a lateral plane view of the first embodiment of the hitting device for cajon according to the present invention.

As shown in FIG. 1 and FIG. 2, the base 1 is formed as elongate shaped and horizontally placed in front of the hitting surface 51 of the cajon 5. The base 1 has a front portion 11 and a side portion 12. The front portion 11 is right ahead the hitting surface 51. The side portion 12 is extending along the width direction of the base 1. The side portion 12 comprises a pivoting portion thereon. In this embodiment, the pivoting portion is a pair of ears 13 protruded from the base 1. The position at where the side portion 12 of the base 1 is located depends upon the heavy foot of the user. In other words, when the heavy foot of the user is the right foot, the side portion 12 would be configured nearby the right side of the cajon 5, while when the heavy foot of the user is the left foot, the side portion 12 would be configured nearby the left side of the cajon 5.

As shown in FIG. 1 and FIG. 2, the cajon hitting assembly 2 comprises a post 21 assembled to the front portion 11 of the base 1. A shaft 22 is assembled on the post 21. A retractable spring 23 is provided at one side of the post 21 for rotating the shaft 22 resiliently when the shaft 22 is rotated. A cajon hitter 24 is fastened to the shaft 22 so that the cajon hitter 24 swings radially with respect to the shaft 22 when the shaft 22 is rotated. An arm 25 is radially extending from the shaft 22. In addition, the extending direction of the arm 25 directs toward the hitting surface 51 of the cajon 5.

As shown in FIG. 1 and FIG. 2, the bar member 3 is pivoted at the two ears 13, and the length direction of the bar member 3 is aligned with the length direction of the base 1. The bar member 3 has a first end and a second end. The first end of the bar member 3 is extending toward the cajon hitting assembly 2 and underneath the arm 25. The bar member 3 is provided with a treading portion 31 for treading by a foot A of a user. In this embodiment, the foot A treads on the treading portion 31 by the heel, but embodiments are not limited thereto. The user may use the sole of his/her foot to tread on the treading portion 31. As shown in FIG. 1 and FIG. 2, the top end of the linking rod 4 is pivoted to an extending end of the arm 25, and the bottom end of the linking rod 4 is pivoted with the first end of the bar member 3.

As shown in FIG. 1 and FIG. 2, in this embodiment, the treading portion 31 is defined between the first end and the second end of the bar member 3, and the linking rod 4 and the two ears 13 are configured at opposite sides of the treading portion 31. The second end of the bar member 3 is distant from the linking rod 4 and pivoted to the two ears 13. In this embodiment, an axle 14 passes through the two ears 13 and the second end of the bar member 3 so that the bar member 3 is pivotally connected to the ears 13 via the axle 14. In this embodiment, the treading portion 31 comprises a pedal plate 32 for the foot A to lie on and tread. In this embodiment, the driving member is the linking rod 4, but embodiments are not limited thereto. Alternatively, flexible articles are adapted to be the driving member, such as a chain, a wire, or a belt.

Figure 3:
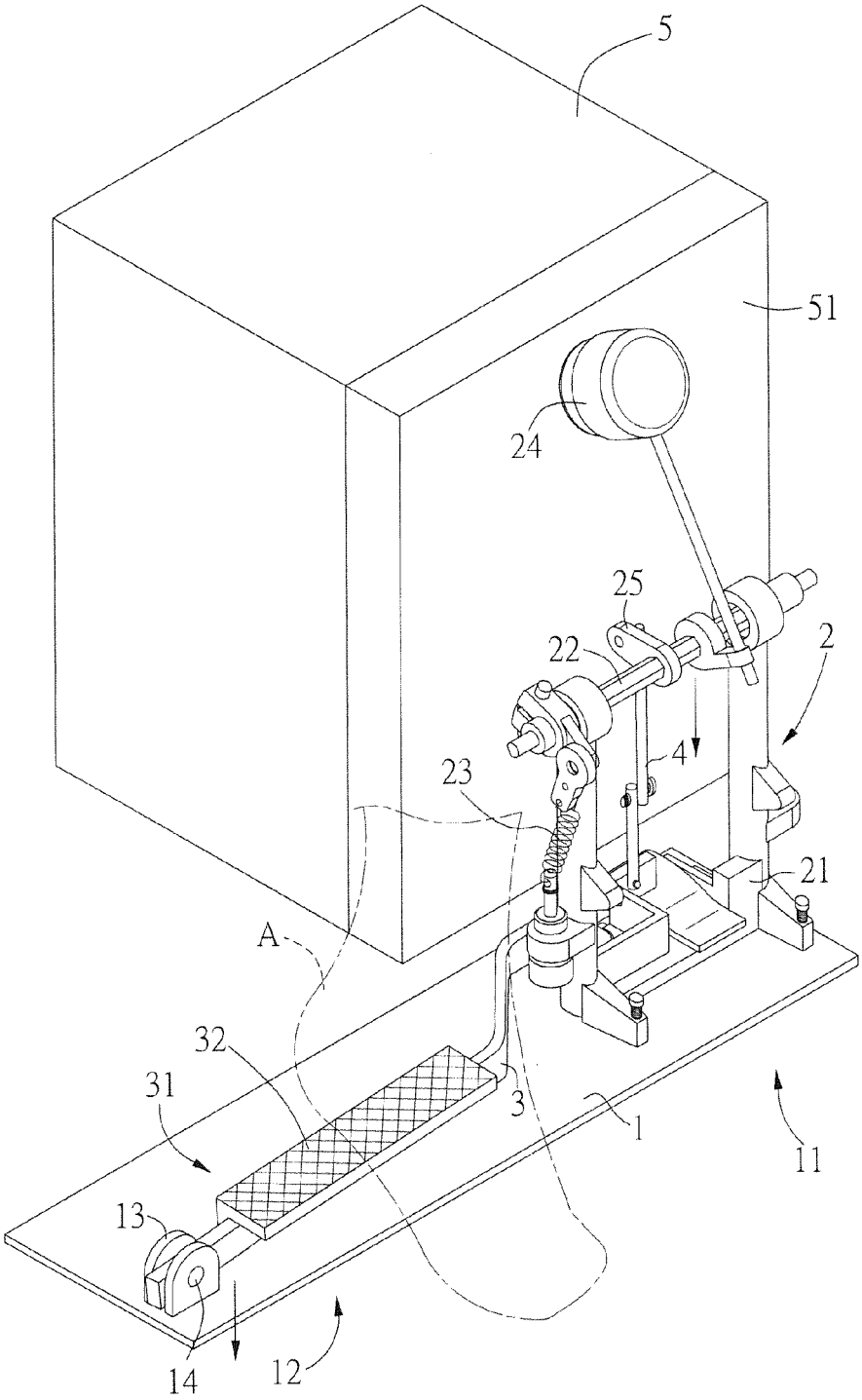
FIG. 3 illustrates a schematic operational view of the first embodiment of the hitting device for cajon according to the present invention.

As shown in FIG. 3, in operation, the foot A at the side portion 12 of the base 1 treads on the pedal plate 32 of the treading portion 31, so that the first end of the bar member 3 is pivoted about the two ears 13 to drive the linking rod 4 moving longitudinally. Therefore, the arm 25 drives the shaft 22 to rotate along a direction where the cajon hitter 24 moves forward the hitting surface 51 of the cajon 5. In this embodiment, when the foot A treads on the pedal plate 32 of the treading portion 31, the linking rod 4 pivoted to the first end of the bar member 3 is driven to move downward to rotate the shaft 22 along a direction where the cajon hitter 24 moves forward the hitting surface 51 of the cajon 5.

Accordingly, unlike the complicated design of the conventional, the structure of the hitting device for cajon according to the present invention is much simple. Therefore, the material cost can be reduced, and the assembling of the hitting device for cajon can be quickly and efficient.

Figure 4:
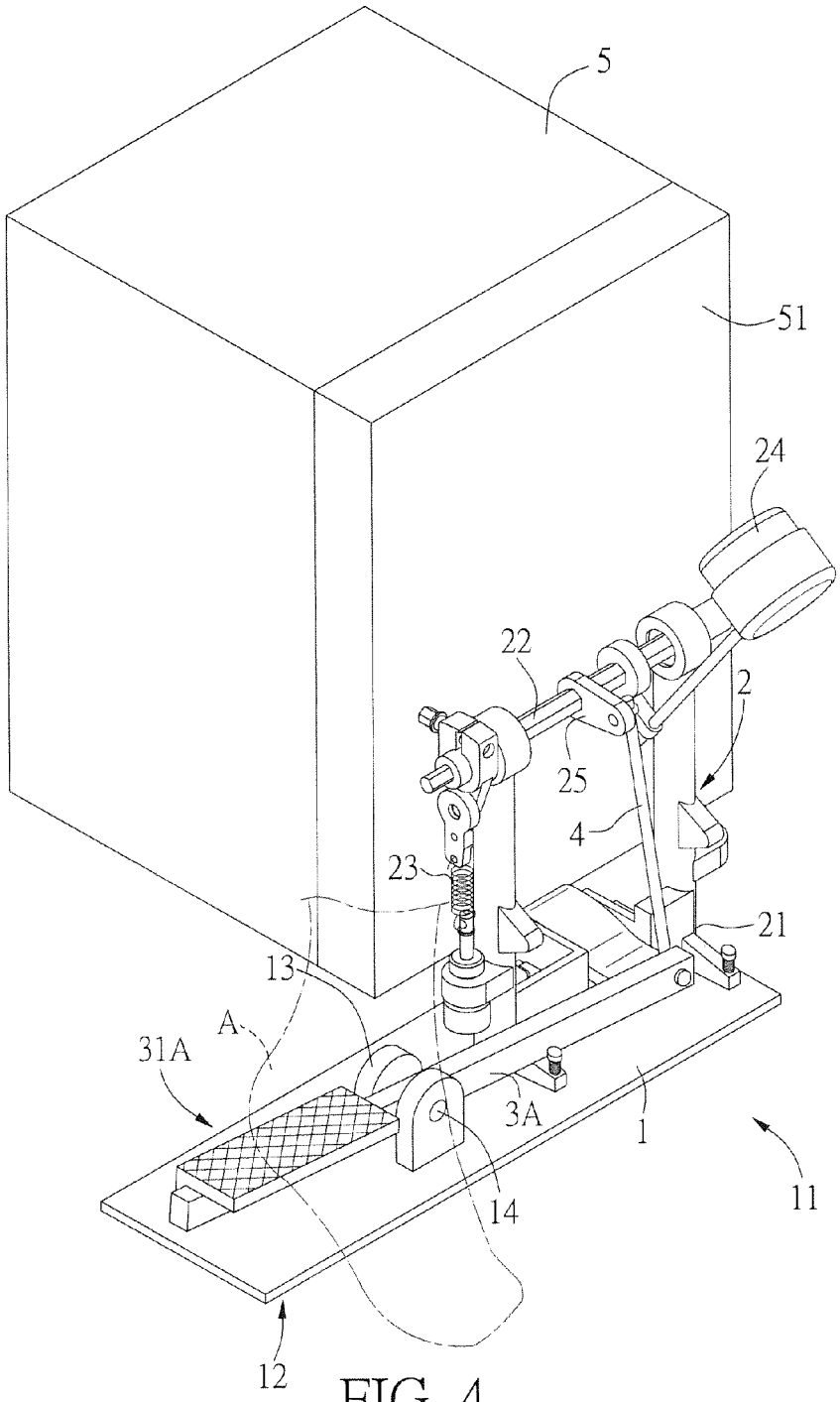
FIG. 4 illustrates a perspective view of a second embodiment of a hitting device for cajon according to the present invention.
Figure 5:
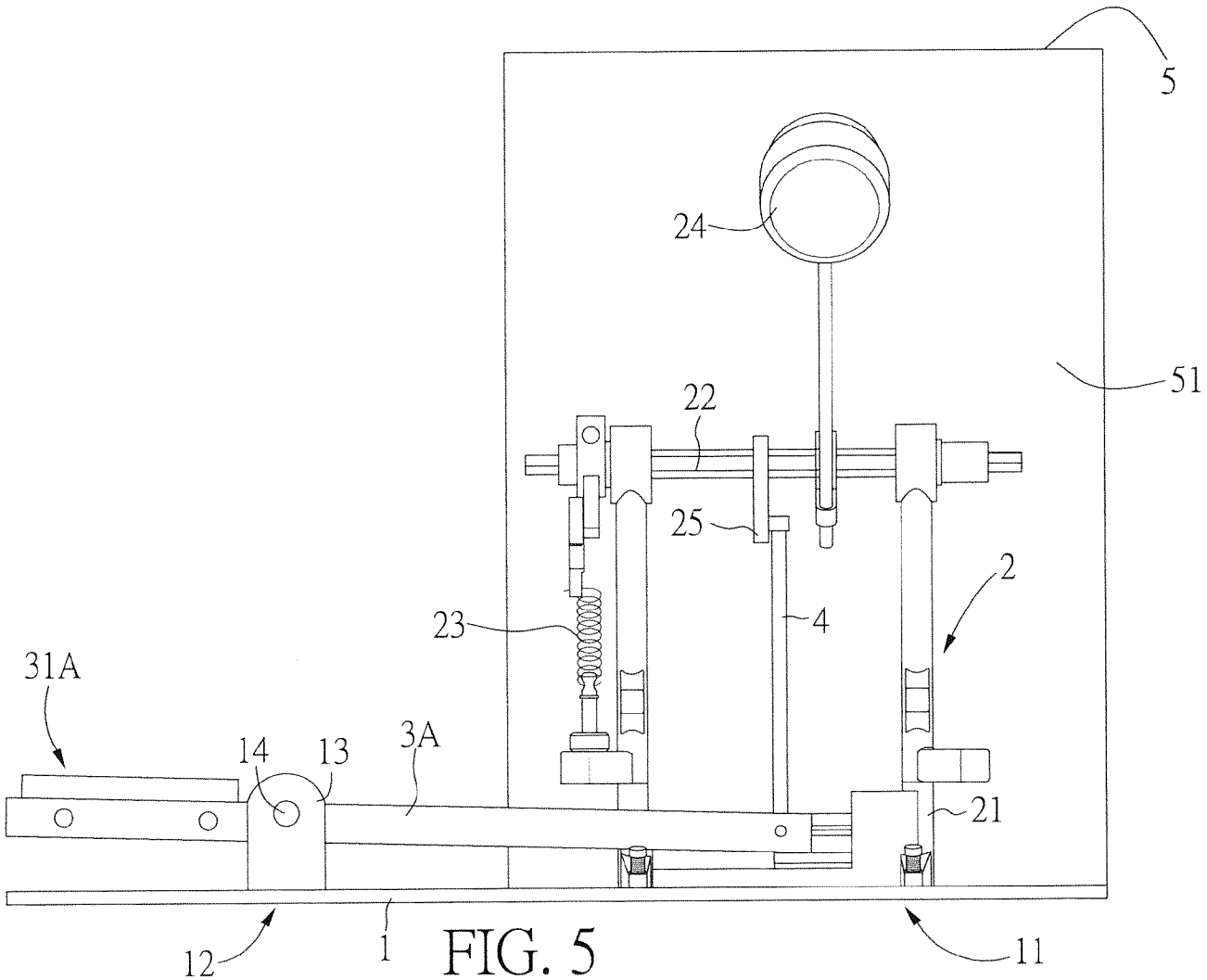
FIG. 5 illustrates a lateral plane view of the second embodiment of the hitting device for cajon according to the present invention.
Figure 6:
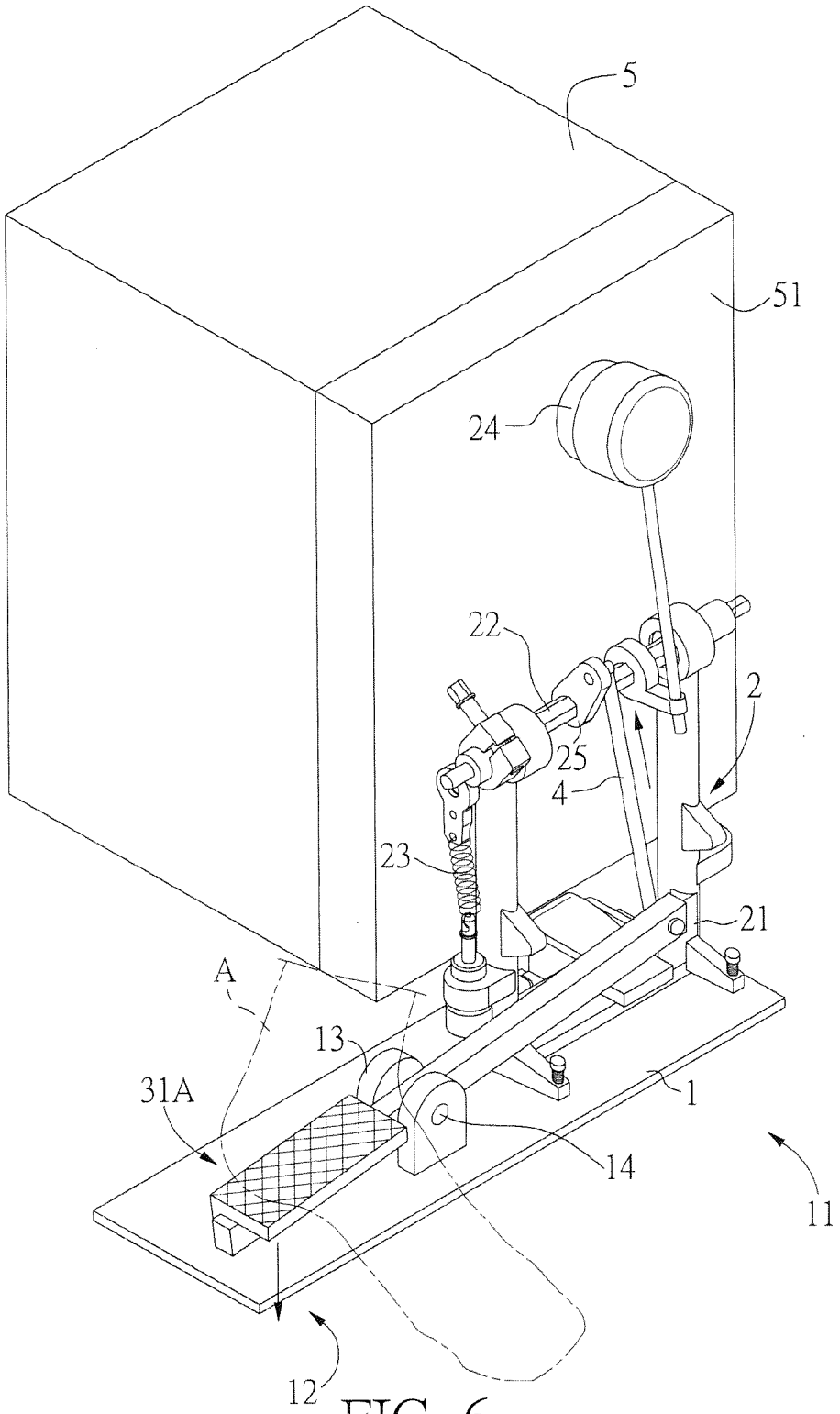
FIG. 6 illustrates a schematic operational view of the second embodiment of the hitting device for cajon according to the present invention.

It is understood that the present invention may include several variations or modifications. Please refer to FIG. 4 to FIG. 6, illustrating a second embodiment of a hitting device for cajon according to the present invention. The second embodiment is approximately similar to the first embodiment, except that in the second embodiment, the two ears 13A are defined between the first end and the second end of the bar member 3A, and the base 1 is pivoted with the bar member 3A via the two ears 13A. The linking rod 4 and the treading portion 31A are configured at opposite sides of the two ears 13A. In this embodiment, the extending direction of the arm 25 is opposite from that of the arm 25 in the first embodiment. Specifically, in this embodiment, the extending direction of the arm 25 is far from the hitting surface 51 of the cajon 5. As shown in FIG. 6, when the foot A treads on the treading portion 31A, the linking rod 4 pivoted to the first end of the bar member 3A is driven to move upward to rotate the shaft 22 along a direction where the cajon hitter 24 moves forward the hitting surface 51 of the cajon 5. Therefore, the second embodiment carries out the same function as the first embodiment does.

Figure 7:
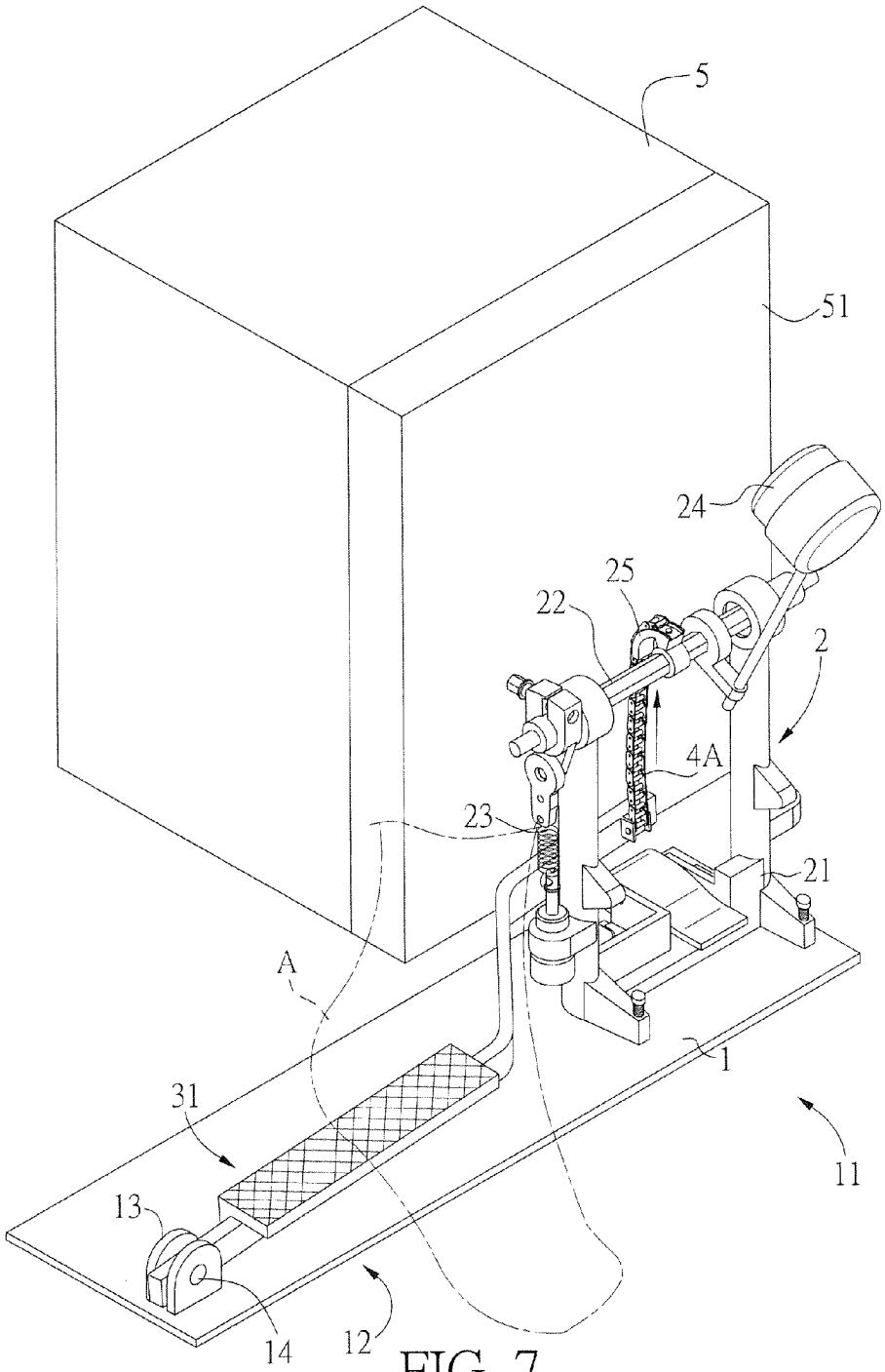
FIG. 7 illustrates a perspective view of a third embodiment of a hitting device for cajon according to the present invention.
Figure 8:
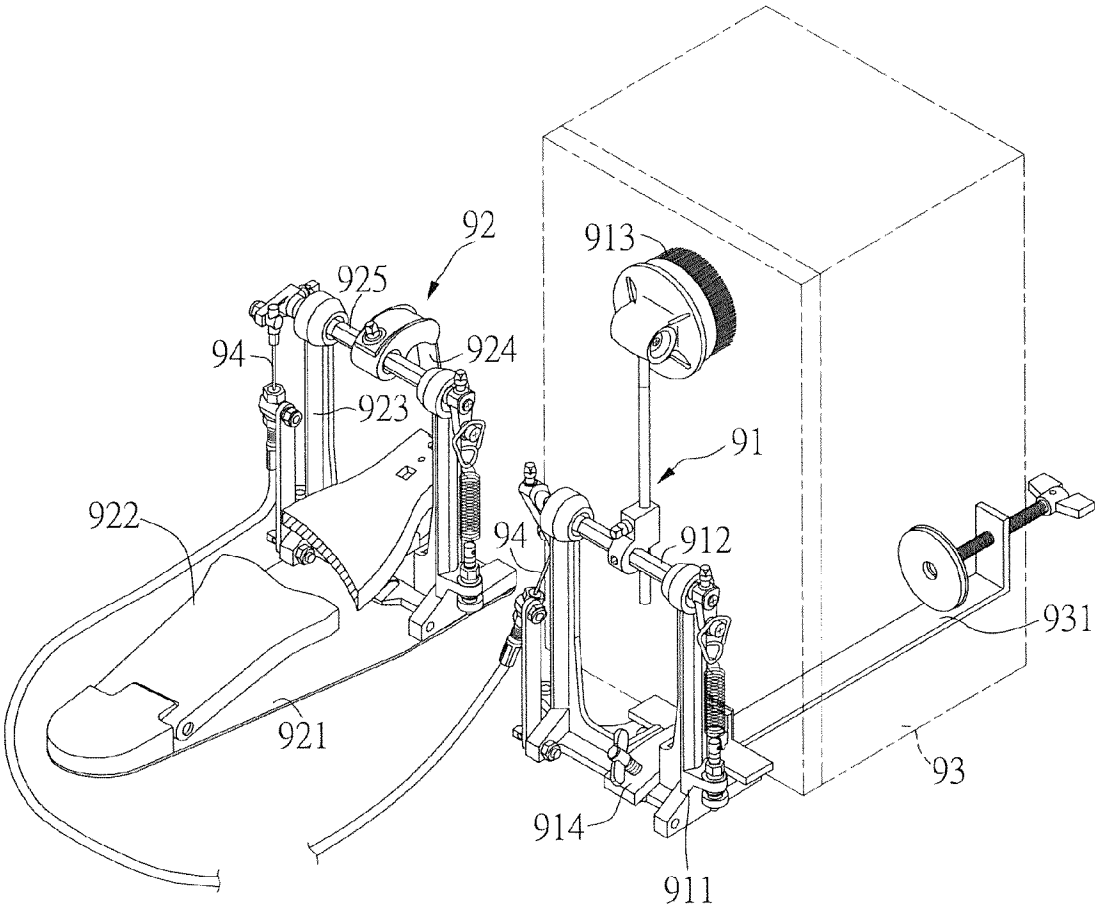
FIG. 8 PRIOR ART
FIG. 8 illustrates a perspective view of a conventional cajon hitting device.

Please refer to FIG. 7, illustrating a third embodiment of a hitting device for cajon according to the present invention. The third embodiment is approximately similar to the first embodiment, except that in the third embodiment, instead of the linking rod 4, the driving member is a chain 4A. The third embodiment also carries out the same function as the first embodiment does.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A hitting device for cajon, comprising:

a base being formed as elongate shaped, wherein the base is horizontally placed in front of a hitting surface of a cajon, the base has a front portion and a side portion, the front portion is right ahead the hitting surface, the side portion is extending along the width direction of the base and comprises a pivoting portion thereon;

a cajon hitting assembly, comprising a post assembled to the front portion of the base, wherein a shaft is assembled on the post, a retractable spring is provided at one side of the post for rotating the shaft resiliently when the shaft is rotated, wherein a cajon hitter is fastened to the shaft so that the cajon hitter swings radially with respect to the shaft when the shaft is rotated, and wherein an arm is radially extending from the shaft, the arm and the pivoting portion are aligned at the same plane of the base;

a bar member pivoting at the pivoting portion, wherein the length direction of the bar member is aligned with the length direction of the base, the bar member has a first end and a second end, the first end of the bar member is extending toward the cajon hitting assembly and underneath the arm, the bar member is provided with a treading portion for pedaling; and a driving member having an top end and a bottom end, wherein the top end of the driving member is pivoted to an extending end of the arm, the bottom end of the driving member is pivoted with the first end of the bar member, wherein when the treading portion is treaded, the first end of the bar member is pivoted about the pivoting portion, so that the bar member drives the driving member to move longitudinally and the arm drives the shaft to rotate along a direction where the cajon hitter moves forward the hitting surface of the cajon.

2. The hitting device for cajon according to claim 1, wherein the treading portion is defined between the first end and the second end of the bar member, the driving member is a linking rod, the linking rod and the pivoting portion are configured at opposite sides of the treading portion, the second end of the bar member is distant from the linking rod and pivoted to the pivoting portion, wherein when the treading portion is treaded, the linking rod pivoted to the first end of the bar member is driven to move downward to rotate the shaft along a direction where the cajon hitter is moved forward the hitting surface of the cajon.

3. The hitting device for cajon according to claim 1, wherein the pivoting portion is defined between the firs end and the second end of the bar member, the pivoting portion is pivoted with the bar member, the driving member is a linking rod, the linking rod and the treading portion are configured at opposite sides of the pivoting portion, wherein when the treading portion is treaded, the linking rod pivoted to the first end of the bar member is driven to move upward to rotate the shaft along a direction where the cajon hitter is moved forward the hitting surface of the cajon.

4. The hitting device for cajon according to claim 1, wherein the pivoting portion is a pair of ears protruded from the base, and an axle passes through the two ears and the second end of the bar member so that the bar member is pivotally connected to the pivoting portion.

5. The hitting device for cajon according to claim 1, wherein the treading portion comprises a pedal plate for foot laying and treading.

6. The hitting device for cajon according to claim 1, wherein the driving member is a chain.

* * * * *